US006957867B1

(12) United States Patent
Su

(10) Patent No.: US 6,957,867 B1
(45) Date of Patent: Oct. 25, 2005

(54) HEIGHT-ADJUSTABLE ARMREST

(76) Inventor: Tung-Hua Su, No. 6, Sec. 3, Bao Ta Road, Kuwi Jen Hsiang, Tainan Hsien (TW)

( * ) Notice: Subject to any disclaimer, the term of this patent is extended or adjusted under 35 U.S.C. 154(b) by 0 days.

(21) Appl. No.: 11/114,854

(22) Filed: Apr. 26, 2005

(51) Int. Cl.[7] ..... A47C 7/54
(52) U.S. Cl. ..... 297/411.36; 297/411.2; 297/411.27; 297/410; 297/353
(58) Field of Search ..... 297/411.36, 411.2, 297/411.27, 410, 353

(56) References Cited

U.S. PATENT DOCUMENTS 5,895,095 A * 4/1999 Chen ..... 297/411.36
6,062,646 A * 5/2000 Bock ..... 297/411.36
6,296,313 B1 * 10/2001 Wu ..... 297/411.35
6,659,561 B1 * 12/2003 Lee ..... 297/411.35
6,837,545 B1 * 1/2005 Ho ..... 297/411.36
6,896,333 B1 * 5/2005 Matern et al. ..... 297/411.36

FOREIGN PATENT DOCUMENTS

GB 2255277 * 4/1992

* cited by examiner

*Primary Examiner*—Laurie K. Cranmer
(74) *Attorney, Agent, or Firm*—Charles E. Baxley

(57) ABSTRACT

A height-adjustable armrest for a chair includes a body, a coupling seat, and an adjusting device mounted to the coupling seat. The body includes an arm support section for supporting an arm of a user. The body further includes a tubular section having a vertical slot with a plurality of vertically spaced positioning grooves. The coupling seat includes a longitudinal hole so as to be mounted around the tubular section of the body. The adjusting device includes a push button and a positioning member having a positioning section that is releasably and selectively engaged in one of the positioning grooves. The positioning section of the positioning member is disengaged from the positioning grooves when the push button is pushed, allowing adjustment of a height of the body.

5 Claims, 6 Drawing Sheets

HEIGHT-ADJUSTABLE ARMREST

BACKGROUND OF THE INVENTION

1. Field of the Invention

The present invention relates to an armrest for a chair. In particular, the present invention relates to a height-adjustable armrest for a chair.

2. Description of the Related Art

It is common to mount two armrests on two sides of a chair to provide a support for the arms of the user. The armrests of most of chairs are fixed. Some of the chairs are designed to allow adjustment of the height of the armrests to suit users of different heights. An arrangement for adjusting the height of an armrest includes a knob that can be turned for adjusting purposes. However, the adjusting operation is inconvenient, and the height-adjustable armrest is not stable in structure.

SUMMARY OF THE INVENTION

An objective of the present invention is to provide an armrest that allows easy adjustment in a height thereof.

Another objective of the present invention is to provide a height-adjustable armrest having a stable structure.

A height-adjustable armrest for a chair in accordance with the present invention comprises a body, a coupling seat, an adjusting device, and a connecting frame. The connecting frame includes a first engaging portion securely connected to the coupling seat and a second engaging portion securely connected to a seat of a chair.

The body comprises an arm support section on an upper end thereof for supporting an arm of a user. The body further comprises a tubular section having a vertical slot with a plurality of vertically spaced positioning grooves. A reduced section is formed between a pair of the positioning grooves adjacent to each other.

The coupling seat comprises a longitudinal hole and mounted around the tubular section of the body. The coupling seat comprises a coupling section that has a through-hole in communication with the longitudinal hole of the coupling seat.

The adjusting device is mounted to the coupling section. The adjusting device comprises a positioning member, an elastic element, and a push button. The positioning member extends through the through-hole of the coupling seat and the vertical slot of the body. The positioning member includes a first end in the tubular section and a second end connected to the push button to move therewith. The first end of the positioning member includes a positioning section that is releasably and selectively engaged in one of the positioning grooves. The elastic element is mounted between the coupling seat and the push button for biasing the positioning section of the positioning member into one of the positioning grooves. The positioning section has a width greater than that of each reduced section of the body. The positioning section of the positioning member is disengaged from the positioning grooves when the push button is pushed, allowing adjustment of a height of the body.

Preferably, the body comprises a stop that abuts against the coupling seat when the body is in a lowest position thereof.

Preferably, the coupling seat includes a vertical guide groove in a periphery delimiting the longitudinal hole, and the body comprises a vertical guide rib slidably engaged in the vertical guide groove.

Preferably, the coupling section of the coupling seat comprises an annular wall on an outer periphery of the coupling seat. The through-hole is defined in an area delimited by the annular wall. An annular groove is defined in the area and surrounds the through-hole. The first end of the elastic element is received in the annular groove. The second end of the positioning member is preferably threaded. The push button includes a hollow shank extending from a side thereof, with a screw hole being defined in an end wall of the hollow shank for engaging with the threaded second end of the positioning member, and with the second end of the elastic element abutting against the end wall of the hollow shank.

Preferably, the coupling seat comprises an attachment section including a receiving hole. A positioning projection is formed on an end wall delimiting the receiving hole. The first engaging portion of the connecting frame is received in the receiving hole and includes a notch for engaging with the positioning projection.

Other objectives, advantages, and novel features of the invention will become more apparent from the following detailed description when taken in conjunction with the accompanying drawings.

DETAILED DESCRIPTION OF THE PREFERRED EMBODIMENT

Figure 1:
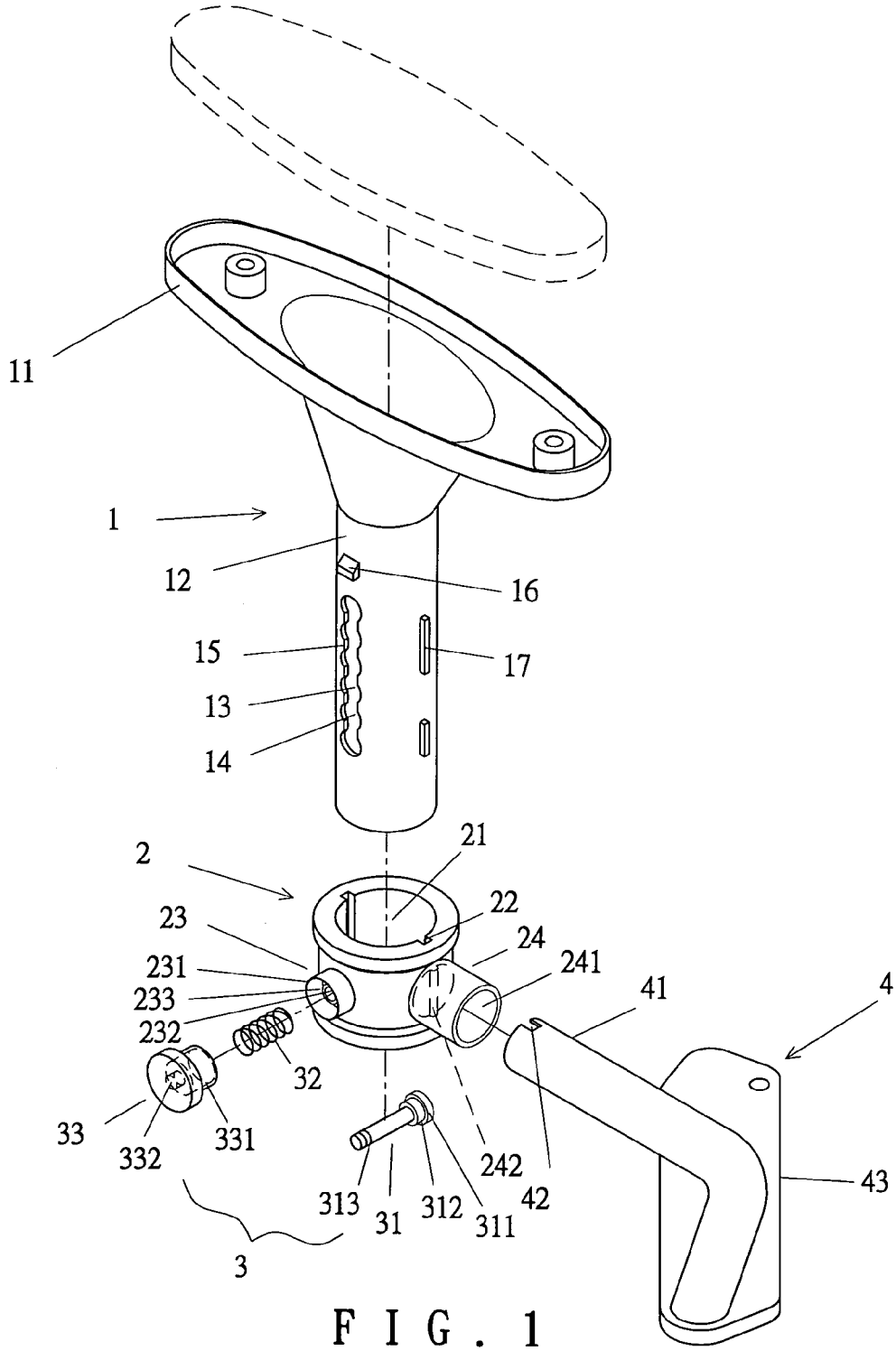
FIG. 1 is an exploded perspective view of a height-adjustable armrest for a chair in accordance with the present invention.
Figure 2:
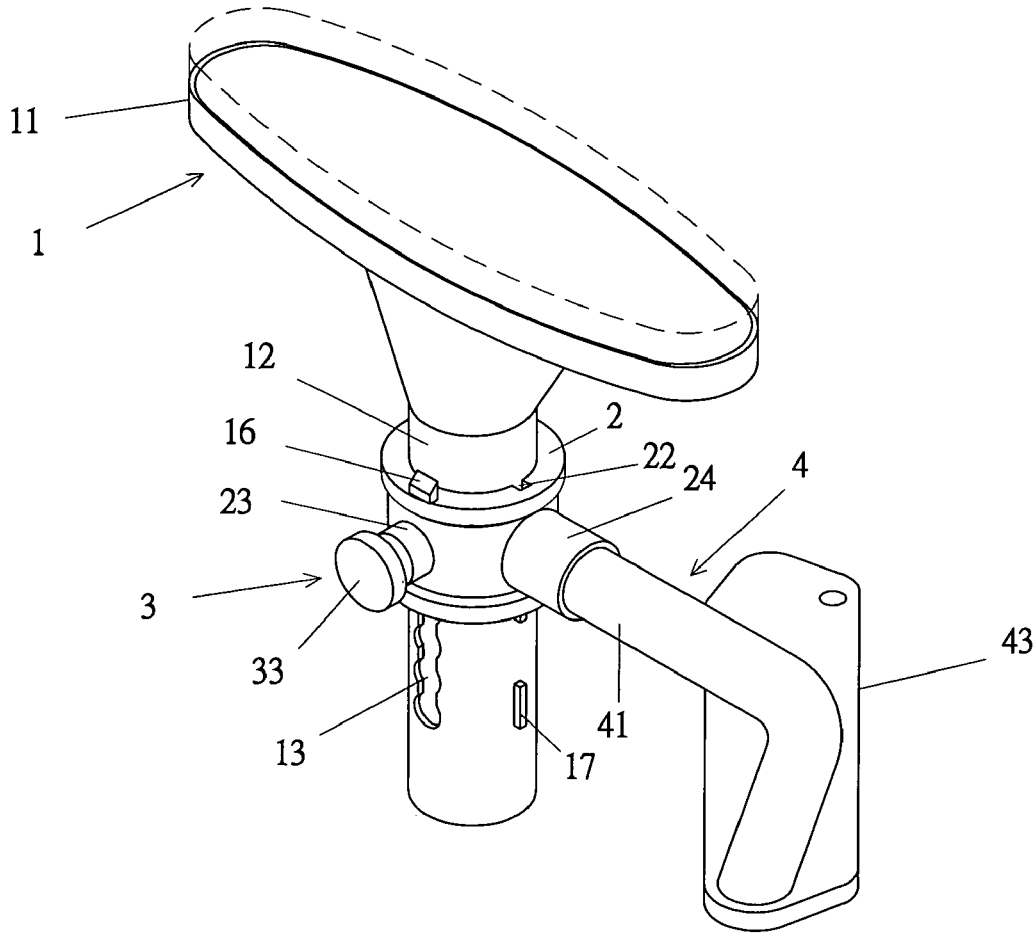
FIG. 2 is a perspective view of the height-adjustable armrest in accordance with the present invention.

Referring to FIGS. 1 through 4, a height-adjustable armrest for a chair in accordance with the present invention comprises a body 1, a coupling seat 2, an adjusting device 3, and a connecting frame 4.

The body 1 includes an arm support section 11 on an upper end thereof for supporting an arm of a user. The body 1 further includes a tubular section 12 that has a vertical slot 13. A plurality of vertically spaced positioning grooves 14 are defined in a perimeter delimiting the vertical slot 13, with a reduced section 15 defined between a pair of positioning grooves 14 adjacent to each other. Further, the body 1 includes at least one vertical guide rib 17 for preventing rotation of the body 1, which will be described later.

The coupling seat 2 includes a longitudinal hole 21 so as to be mounted around the tubular section 12. At least one vertical guide groove 22 is defined in a periphery delimiting the longitudinal hole 21. The vertical guide rib 17 is slidably received in the vertical guide groove 22 for preventing rotation of the body 1.

The coupling seat 2 further includes a coupling section 23 on an outer periphery thereof for coupling with the adjusting device 3. The coupling section 23 includes an annular wall 231, with a through-hole 232 extending through an area delimited by the annular wall 231 and in communication with the longitudinal hole 21 of the coupling seat 2. Further, an annular groove 233 is defined in the area delimited by the annular wall 231 and surrounds the through-hole 231. Further, the coupling seat 2 includes an attachment section 24 having a receiving hole 241 and a positioning projection 242 on an end wall delimiting the receiving hole 241.

The adjusting device 3 includes a positioning member 31, an elastic element 32, and a push button 33. The positioning member 31 extends through the through-hole 232 of the coupling seat 2 and the vertical slot 13 of the tubular section 12. The positioning member 31 includes a first end 311 in the tubular section 12 of the body 1 and a second end 313 that is preferably threaded. The first end 311 includes a positioning section 312 that is releasably and selectively engaged in one of the positioning grooves 14 of the body 1. The positioning section 312 has a width that is greater than that of each reduced section 15 of the body 1.

The elastic element 32 may be a compression spring. The elastic element 32 includes an end received in the annular groove 233 of the coupling seat 2. The push button 33 includes a hollow shank 331 extending from a side thereof, with a screw hole 332 defined in an end wall of the hollow shank 331. The threaded second end 313 of the positioning member 31 is engaged with the screw hole 332 of the push button 33. The other end of the elastic element 32 abuts against the end wall of the hollow shank 331.

The connecting frame 4 includes an engaging portion 41 on an end thereof. The engaging portion 41 is fittingly received in the receiving hole 241 of the coupling seat 2. The engaging portion 41 includes a notch 42 for engaging with the positioning projection 242 of the coupling seat 2. This prevents rotation of the coupling seat 2 and provides a stable structure. Formed on the other end of the connecting frame 4 is an engaging portion 43 for engaging with a seat 5 of a chair, as shown in FIG. 4.

Figure 3:
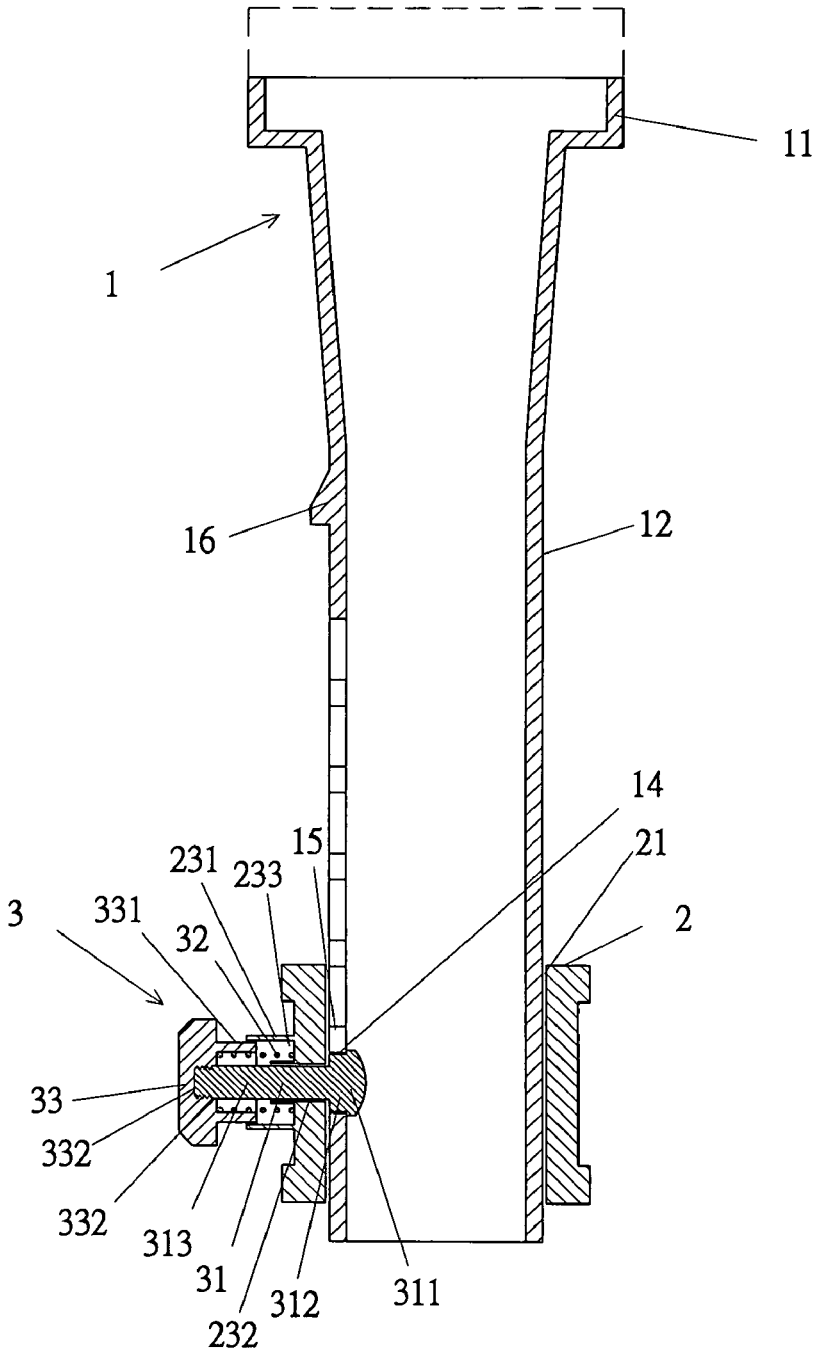
FIG. 3 is a sectional view of the height-adjustable armrest in accordance with the present invention.
Figure 4:
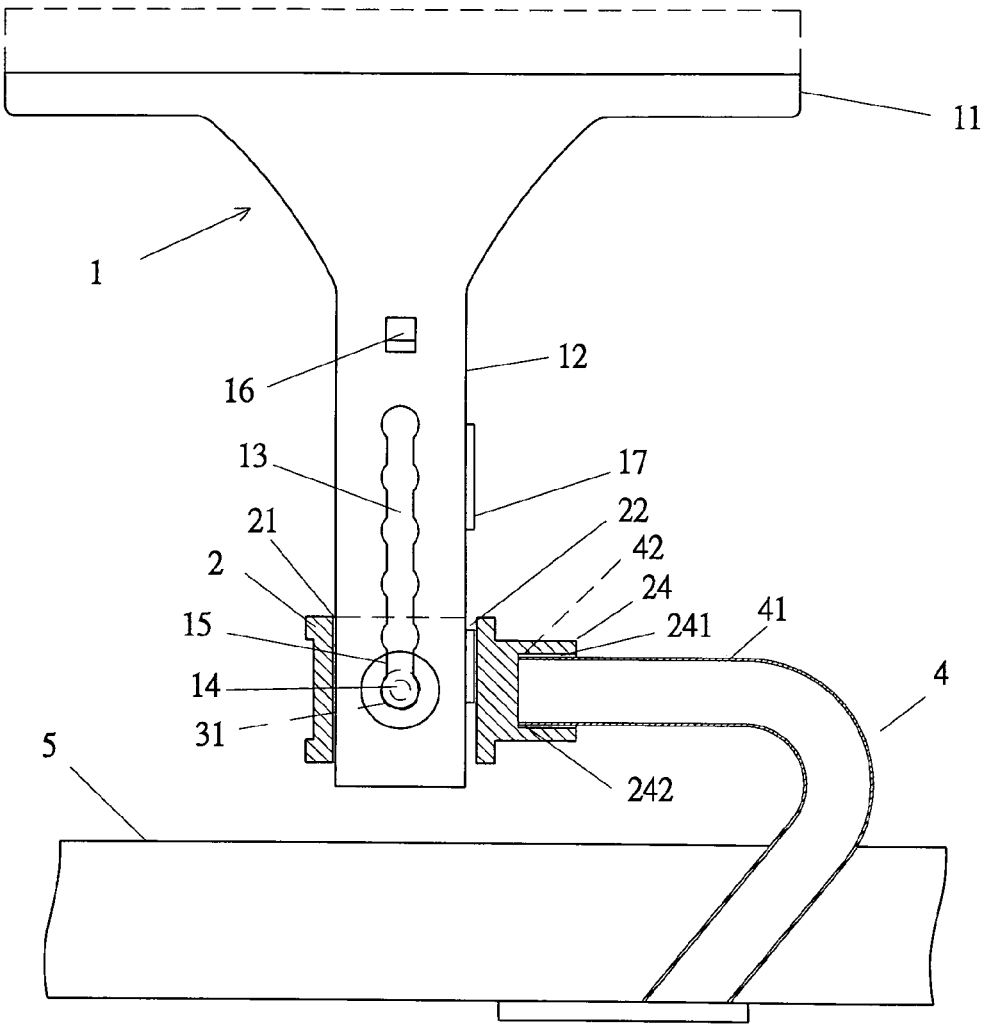
FIG. 4 is another sectional view of the height-adjustable armrest in accordance with the present invention.

Referring to FIGS. 3 and 4, the push button 33 is normally in a released position in which the positioning section 312 of the positioning member 31 is positioned in one of the positioning grooves 14 under the action of the elastic element 32.

Figure 5:
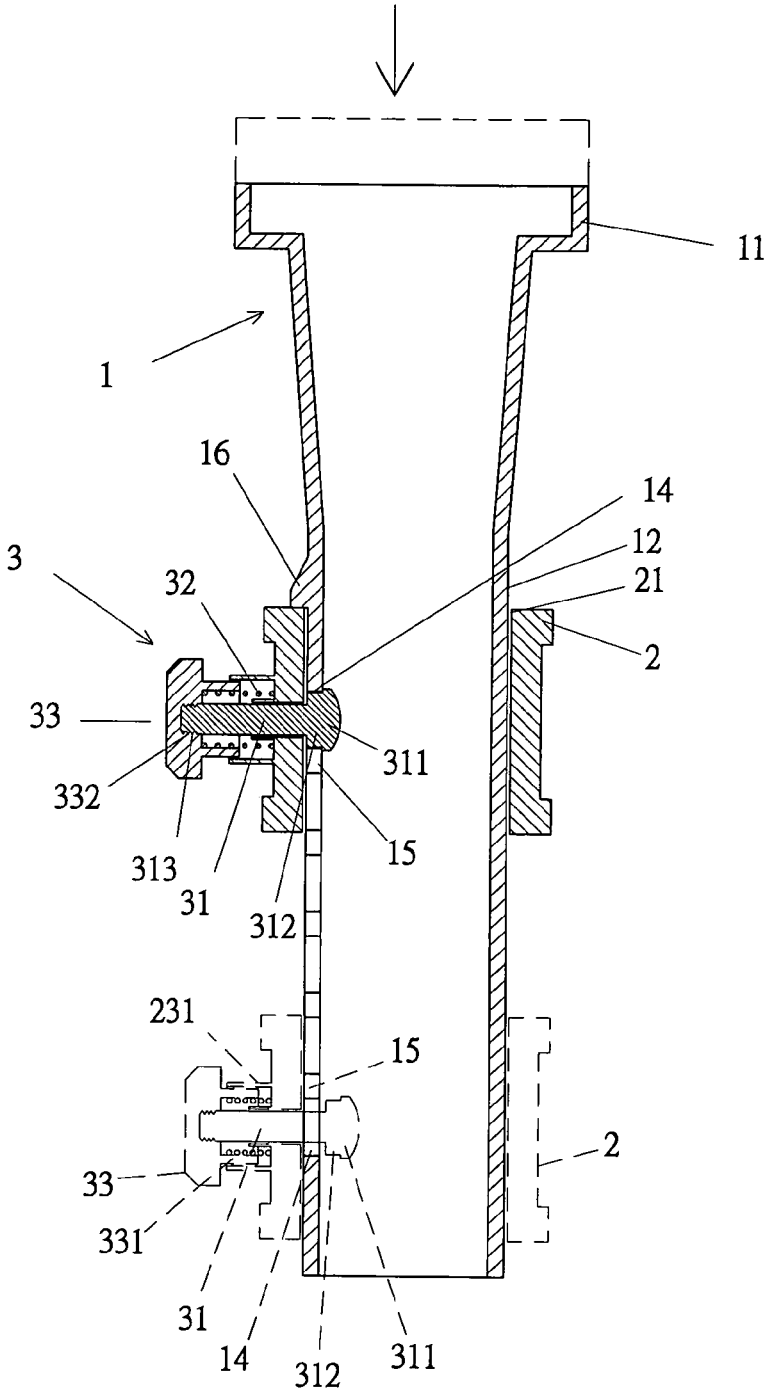
FIG. 5 is a view similar to FIG. 3, illustrating adjustment of the armrest.
Figure 6:
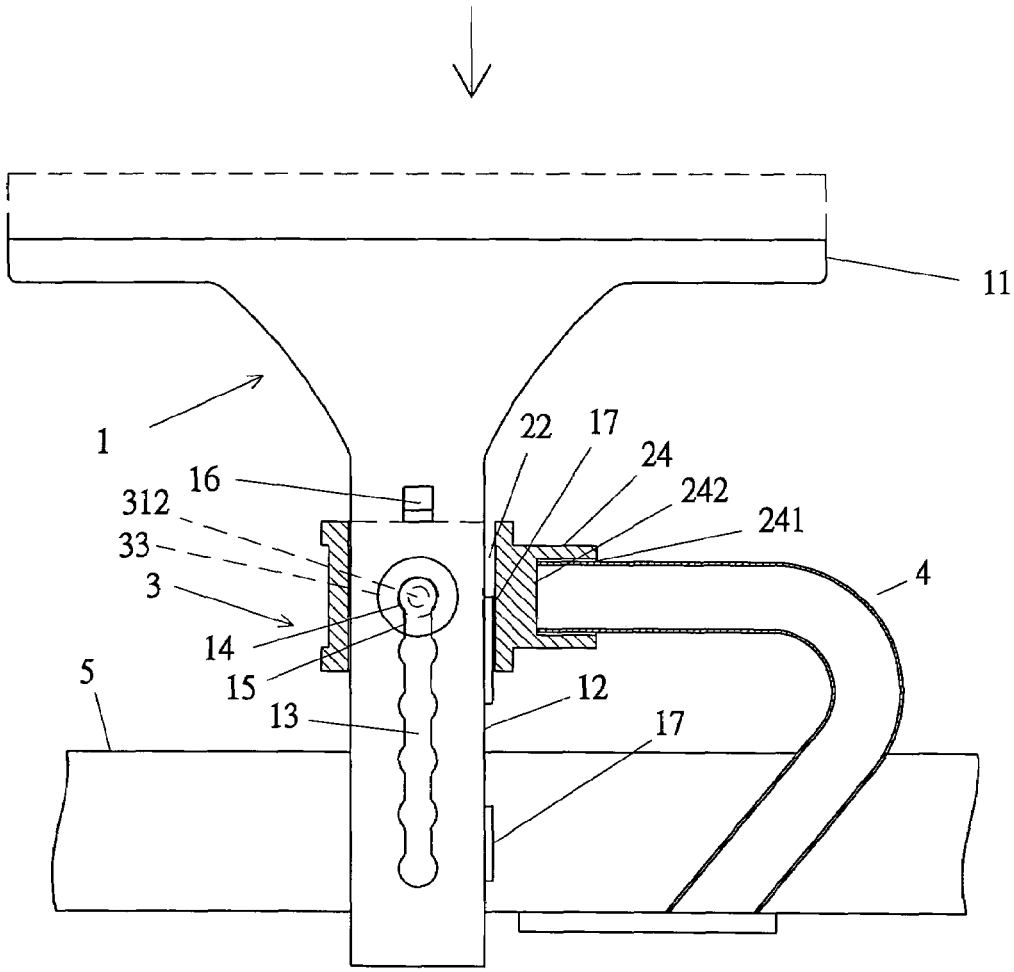
FIG. 6 is a view similar to FIG. 4, illustrating adjustment of the armrest.

Referring to FIGS. 5 and 6, when the push button 33 is pushed such that the positioning section 312 of the positioning member 31 is disengaged from the positioning grooves 14 (see the phantom lines in FIG. 5), the body 1 vertically moved until the arm support section 11 reaches the desired level, and the push button 33 is then released. Rotation of the body 1 is prevented by the vertical guide rib 17 of the body 1 that is slidably received in the vertical guide groove 22 of the coupling seat 2. The vertical slot 13 is sized to allow smooth movement of the body 1 during adjustment of the height of the armrest.

When the body 1 reaches its lowest position shown in FIGS. 5 and 6, a stop 16 on the body 1 abuts against the coupling seat 2 to prevent further downward movement of the body 1. This prevents the positioning member 31 from being damaged by an upper edge delimiting the vertical slot 13 in a case that the body 1 is subjected to a relatively large downward force while proceeding with adjustment of the height of the armrest.

The hollow shank 331 of the push button 33 moves inside the annular wall 231 of the coupling seat 2, preventing deviation of the push button 33. The adjusting operation is thus smooth, easy, and reliable.

Although a specific embodiment has been illustrated and described, numerous modifications and variations are still possible without departing from the essence of the invention. The scope of the invention is limited by the accompanying claims.

What is claimed is:

1. A height-adjustable armrest for a chair, comprising:

a body comprising an arm support section on an upper end thereof for supporting an arm of a user, the body further comprising a tubular section having a vertical slot with a plurality of vertically spaced positioning grooves, a reduced section being formed between a pair of the positioning grooves adjacent to each other;

a coupling seat comprising a longitudinal hole and mounted around the tubular section of the body, the coupling seat comprising a coupling section that has a through-hole in communication with the longitudinal hole of the coupling seat;

an adjusting device mounted to the coupling section, the adjusting device comprising a positioning member, an elastic element, and a push button, the positioning member extending through the through-hole of the coupling seat and the vertical slot of the body, the positioning member including a first end in the tubular section and a second end connected to the push button to move therewith, the first end of the positioning member including a positioning section that is releasably and selectively engaged in one of the positioning grooves, the elastic element being mounted between the coupling seat and the push button for biasing the positioning section of the positioning member into one of the positioning grooves, the positioning section having a width greater than that of each said reduced section of the body, the positioning section of the positioning member being disengaged from the positioning grooves when the push button is pushed, allowing adjustment of a height of the body; and a connecting frame including a first engaging portion securely connected to the coupling seat and a second engaging portion securely connected to a seat of a chair.

2. The height-adjustable armrest as claimed in claim 1, wherein the body comprises a stop that abuts against the coupling seat when the body is in a lowest position thereof.

3. The height-adjustable armrest as claimed in claim 1, wherein the coupling seat includes a vertical guide groove in a periphery delimiting the longitudinal hole, and wherein the body comprises a vertical guide rib slidably engaged in the vertical guide groove.

4. The height-adjustable armrest as claimed in claim 1, wherein the coupling section of the coupling seat comprises an annular wall on an outer periphery of the coupling seat, the through-hole being defined in an area delimited by the annular wall, an annular groove being defined in the area and surrounding the through-hole, with the first end of the elastic element being received in the annular groove, the second end of the positioning member being threaded, the push button including a hollow shank extending from a side thereof, with a screw hole being defined in an end wall of the hollow shank for engaging with the threaded second end of the positioning member, and with the second end of the elastic element abutting against the end wall of the hollow shank.

5. The height-adjustable armrest as claimed in claim 1, wherein the coupling seat comprises an attachment section including a receiving hole, with a positioning projection being formed on an end wall delimiting the receiving hole, the first engaging portion of the connecting frame being received in the receiving hole and including a notch for engaging with the positioning projection.

* * * * *